US005271107A

United States Patent [19]

Gof et al.

[11] Patent Number: 5,271,107

[45] Date of Patent: Dec. 21, 1993

[54] INFANT BATHING AND CRIB DEVICE

[76] Inventors: Sonia M. Gof, 1767 N. 10th St., Kalamazoo, Mich. 49009; M. Shamel Gof, 40 Suter La., North Haledon, N.J. 07508

[21] Appl. No.: 959,144

[22] Filed: Oct. 9, 1992

[51] Int. Cl.[5] ..... A47K 3/064

[52] U.S. Cl. ..... 4/572.1; 4/585; 4/587; 5/107; 5/102

[58] Field of Search ..... 4/585, 586, 587, 572.1, 4/546, 547, 551; 5/101, 105, 107, 98.3, 102, 127, 128, 129, 414

[56] References Cited

U.S. PATENT DOCUMENTS

| | | | |
|---|---|---|---|
| 400,119 | 3/1889 | Sabin | 4/587 |
| 801,739 | 10/1905 | Mowry | 4/546 |
| 1,493,505 | 5/1924 | Smith | 4/587 |
| 1,792,696 | 2/1931 | Masters | 4/572.1 |
| 1,846,492 | 2/1932 | Johnson | 4/572.1 |
| 2,102,959 | 12/1937 | Kennedy | 4/572.1 |
| 2,488,225 | 11/1949 | Mover | 5/98.3 |
| 3,012,254 | 12/1961 | Hamilton | 5/414 |

FOREIGN PATENT DOCUMENTS

| | | | |
|---|---|---|---|
| 240268 | 10/1925 | United Kingdom | 5/102 |

*Primary Examiner*—Henry J. Recla
*Assistant Examiner*—Charles R. Eloshway
*Attorney, Agent, or Firm*—Flynn, Thiel, Boutell & Tanis

[57] ABSTRACT

An infant support having a supporting hammock and securement structure therefor for securing the supporting hammock to plural side frame members of the support. An infant holding device is provided and is movable between a first position overlaying from side-to-side an upwardly facing surface of the support hammock and a second position thereof lying at a side thereof. A releasable connection is provided for facilitating a releasable securement of the infant holding structure in the first position, a release of the releasable connection structure facilitating a movement of the infant holding structure to the second position. A pair of parallel rocker slats are provided and a releasable coupling structure is provided for securing each end region of a rocker slat to the lower end of a pair of laterally spaced legs to enable the infant support to be rocked when said rocker slats are connected to the lower ends of respective ends of a transversely spaced pair of legs.

8 Claims, 3 Drawing Sheets

INFANT BATHING AND CRIB DEVICE

FIELD OF THE INVENTION

This invention relates to an infant support and, more particularly, to an infant support that can be utilized both as a crib and as a bathing support for an infant.

BACKGROUND OF THE INVENTION

In the context of this application, reference will be made to an infant, which is to include both a human and a doll. In other words, the infant support can be utilized as a support for a human baby as well as a support for a doll.

It is an object of the invention to provide an infant support for use in bathing an infant.

It is a further object of the invention to provide an infant support, as aforesaid, which can be utilized, in addition, as a crib.

It is a further object of this invention to provide an infant support, as aforesaid, which, when usable as a crib, is rockable.

It is a further object of this invention to provide an infant support, as aforesaid, which includes a support structure for supporting a mosquito netting-like material over an upwardly facing surface of a supporting hammock, which netting-like material has sufficient porosity to allow light and moving air to easily pass therethrough while preventing insects from penetrating the material.

It is a further object of this invention to provide an infant support, as aforesaid, which is wholly collapsible with releasable strap connections being provided for holding all of the components together in a compact packageable arrangement.

It is a further object of this invention to provide an infant support, as aforesaid, wherein, when the infant support is used as a crib, rocker slats for facilitating a rocking of the crib are removable so that the crib can be supported in an upright stationary, non-rocking position.

It is a further object of this invention to provide an infant support, as aforesaid, which includes infant holding straps adapted to overlay an upwardly facing surface of a supporting hammock, securement structure being provided to secure the infant holding straps in such a manner as to securely hold an infant to the upwardly facing supporting hammock surface.

SUMMARY OF THE INVENTION

The objects and purposes of the invention have been met by providing an infant support which includes a pair of side frame members and a leg member pivotally secured to each longitudinal end of the side frame members for movement between an upright position for supporting the side frame members in spaced relation above a support surface on which a lower end of the leg members rest. The frame further includes transverse frame members for establishing a lateral spacing between the side frame members. A supporting hammock and securement structure therefor is provided for securing the supporting hammock to the side frame members. A pair of parallel rocker slats are provided which extend generally perpendicular to a longitudinal axis of the side frame members. A releasable coupling structure is provided for securing each end region of a rocker slat to the lower end of a pair of laterally spaced legs to enable the infant support to be rocked when said rocker slats are connected to the lower ends of respective ends of a transversely spaced pair of legs.

BRIEF DESCRIPTION OF THE DRAWINGS

Other objects and purposes of the invention will be apparent to persons having ordinary skill in this art and upon reading the following specification with reference to the accompanying drawings, in which.

DETAILED DESCRIPTION

Figure 2:
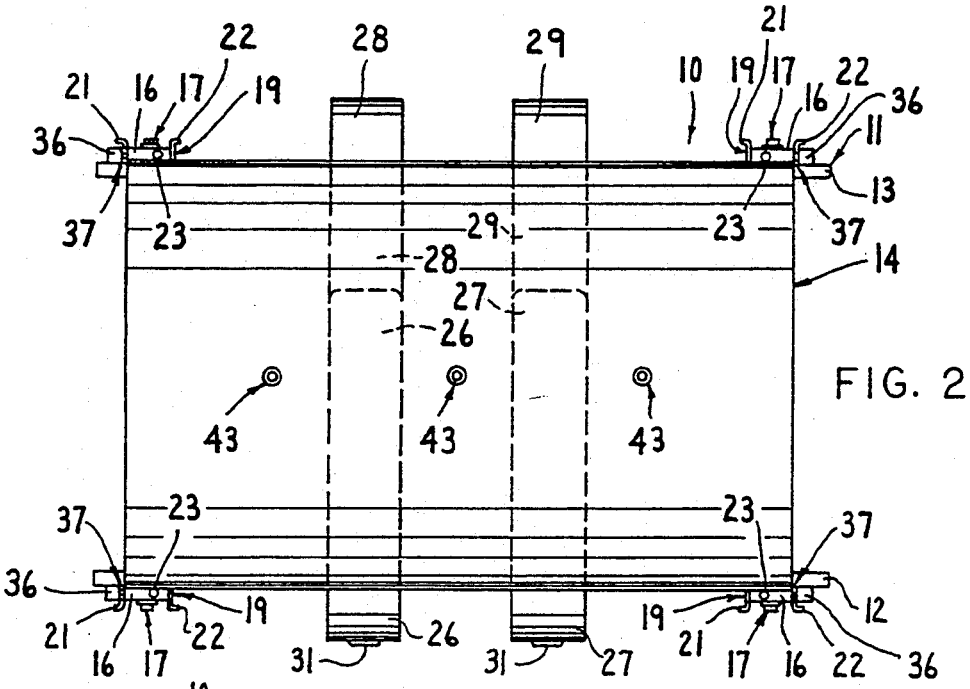
FIG. 2 is a top view thereof.

An infant support 10 embodying our invention is illustrated in the drawings. The infant support 10 includes a frame 11 which consists of a pair of parallel extending side frame members 12 and 13. A support hammock 14 is secured by any convenient means to an upper edge of each of the side frame members 12 and 13 and extends between the aforesaid side frame members 12 and 13 as illustrated in FIGS. 2 and 3.

Figure 7:
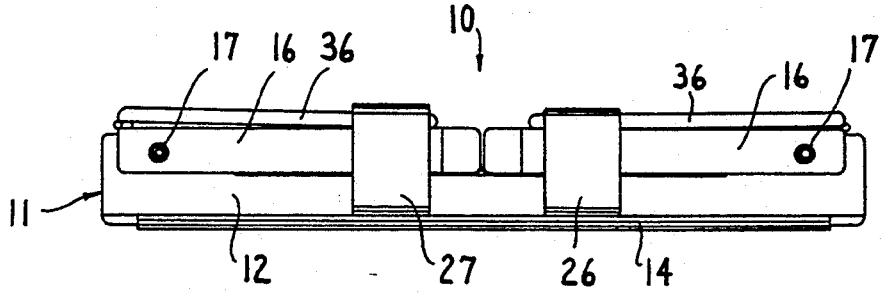
FIG. 7 is a side view of the infant support in a fully collapsed position and upside down in reference to FIG. 6.

The frame 11 includes a plurality of leg members 16, here, four leg members, one each being secured to a longitudinal end of each of the side rails 12 and 13. A nut-and-bolt arrangement 17 effects a pivotal securement of each leg 16 to the respective end of the side frame members 12 and 13. A laterally extending brace member 18 is connected to and extends between a pair of transversely spaced leg members 16 so as to cause the transversely spaced pairs of legs 16 to pivot as a unit and so as to establish a fixed horizontal spacing between the side rails 12 and 13. Each of the leg members 16 and the attached brace member 18 are pivotal about an axis of the nut-and-bolt connection 17 to a position orienting the brace member 18 adjacent the bottom edge of the side frame members 12 and 13 as illustrated in FIG. 7, it being noted that FIG. 7 is upside down in relation to the illustration of FIG. 1.

Figure 1:
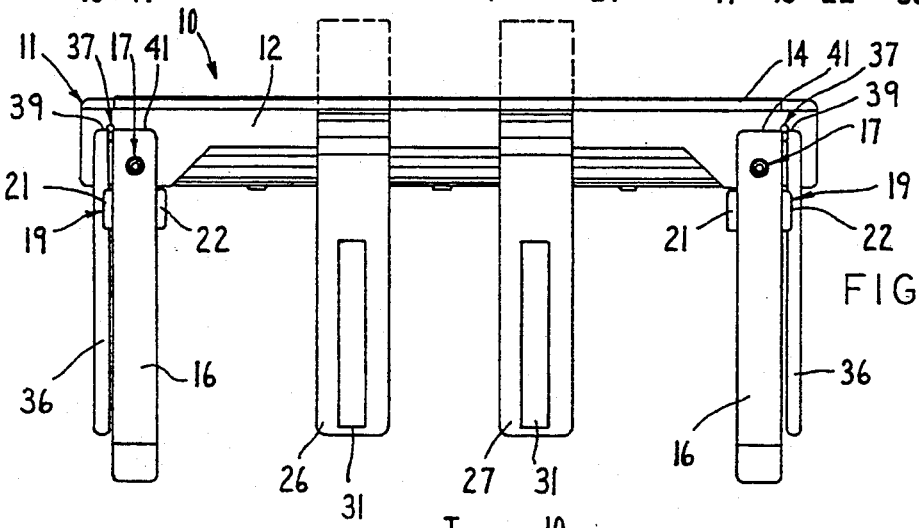
FIG. 1 is a side elevational view of an infant support embodying our invention.
Figure 3:
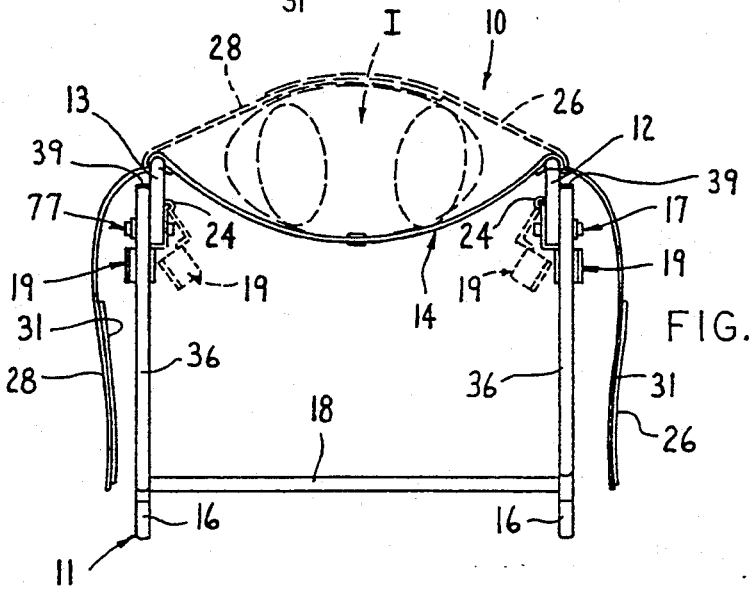
FIG. 3 is a left end view thereof.

A releasable locking mechanism 19 is provided for effecting a securement of the leg members 16 in the respective upright positions illustrated in FIGS. 1 and 3. The releasable locking mechanism 19 includes a base part which is, in this particular embodiment, pivotally secured as at 24 to an inside facing surface of each of the side rails 12 and 13. The base part has laterally spaced arms 21 and 22 (FIG. 2) thereon which straddle the leg member 16 to effectively hold it in its upright position. When the releasable locking mechanism 19 is pivoted to the broken line position illustrated in FIG. 3, the laterally spaced legs 21 and 22 will be removed from the straddling relationship with the legs 16 to thereby enable the leg members 16 and associated brace member 18 to pivot about the axis of the nut-and-bolt assembly 17. An upper end of each leg 16 has a dowel receiving socket 23 therein, the purpose of which will be set forth in more detail below.

A pair of infant holding straps 26 and 27 are secured to the side rail 12 and a further pair of straps 28 and 29 are secured to the side rail 13. The straps 26 to 29 each have a sufficient length to overlay the upwardly facing surface of the support hammock 14 as illustrated in broken lines in FIG. 3. Each strap has connection structure in the form of a strip 31 of VELCRO material thereon, the strip on the strap 36 being adapted to mesh with the strip on the strap 28 to effect a securement of the straps 26 and 28 together and similarly the straps 27 and 29 together. Thus, an infant positioned on the upwardly facing surface of the support hammock 14 will be securely held onto that surface by the aforesaid connected straps 26 and 28 as well as the straps 27 and 29. Each of the straps 26 to 29 are also adapted to overlay the downwardly facing surface of the support hammock 14 for reasons which will be set forth in further detail below and in relation to FIGS. 7 and 8.

Figure 4:
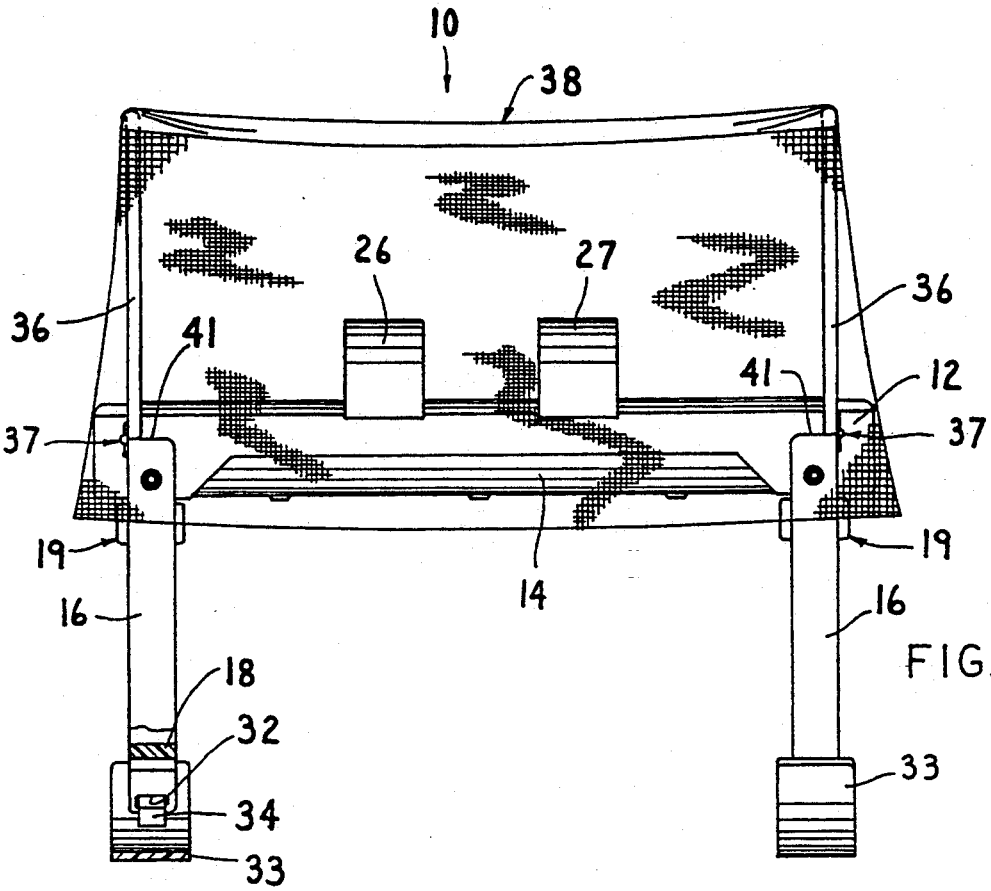
FIG. 4 is a side elevational view of the infant support illustrated in FIG. 1 but with rocker slats and a mosquito netting-like material and a support therefor in the erected position.
Figure 5:
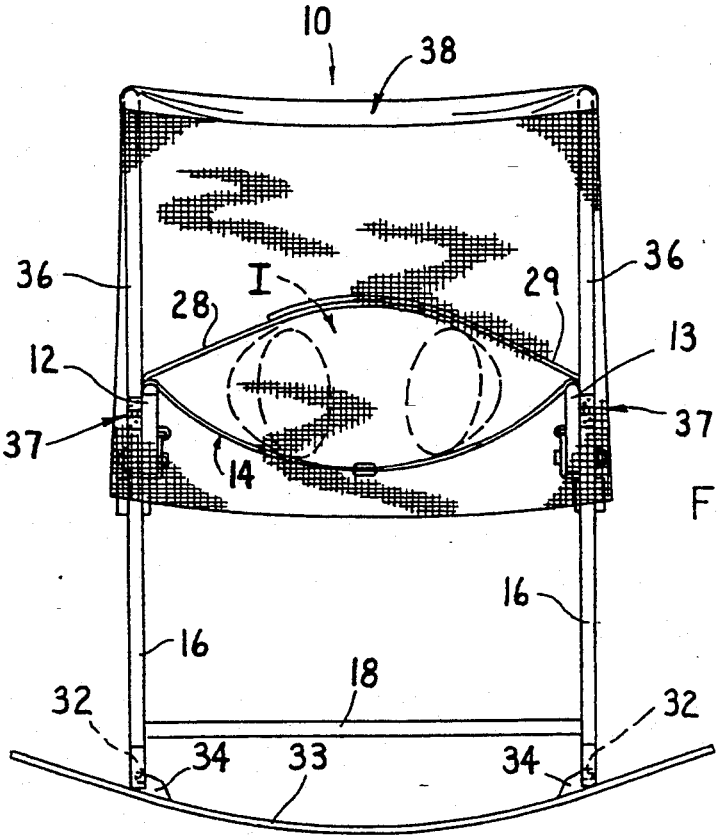
FIG. 5 is an end view of FIG. 4.

The lower end of each leg 16 has a recess 32 therein as illustrated in FIG. 4. In this particular embodiment, each recess 32 is located on an inwardly facing side of the leg members 16. A normally flat rocker slat 33 is provided, which rocker slat has a pair of spaced apart blocks 34 on an upper surface thereof as illustrated in FIG. 5, the spacing being greater than the lateral spacing between the transversely spaced legs 16 interconnected by the brace 18. Each of the blocks 34 has a tongue which is adapted to be received into the recess 32. In order to effect a securement of the rocker slats 33 to the lower ends of each of the two sets of transversely spaced legs 16, it is necessary to flex the rocker slat 33 so that the blocks 34 become oriented at a spacing from one another less than the lateral spacing between the legs 16. A release of the force required to flex the rocker slat 33 will cause the tongues on the blocks 34 to move into the recesses 33 to effect a rigid securement of the rocker slats 33 to each of the legs 16.

Each leg 16 has an arm 36 pivotally secured thereto by a hinge mechanism 37. The arms 36 are each pivotal from a position generally coextensive with the leg 16 as illustrated in FIG. 1 to an upstanding position illustrated in FIG. 4 and constituting an extension of the legs 16. The hinges 37 on each of the legs 16 face toward a respective longitudinal end of the infant support. Thus, when the arms 36 are in their upright position illustrated in FIG. 4, a mosquito netting-like material 38 can be draped over the upper ends of the arms 37. The material 38 will prevent the arms 36 from pivoting about the axes of the respective hinges 37. The upper ends 39 of each of the arms 36 (see FIG. 1) are adapted to rest on the upper end surface 41 of the legs 16 when the legs 36 are in their upright position illustrated in FIG. 4. Thus, and referring to FIG. 4, the legs 37 are unable to pivot toward the lengthwise center of the infant support due to the engagement of the surfaces 39 and 41.

Figure 6:
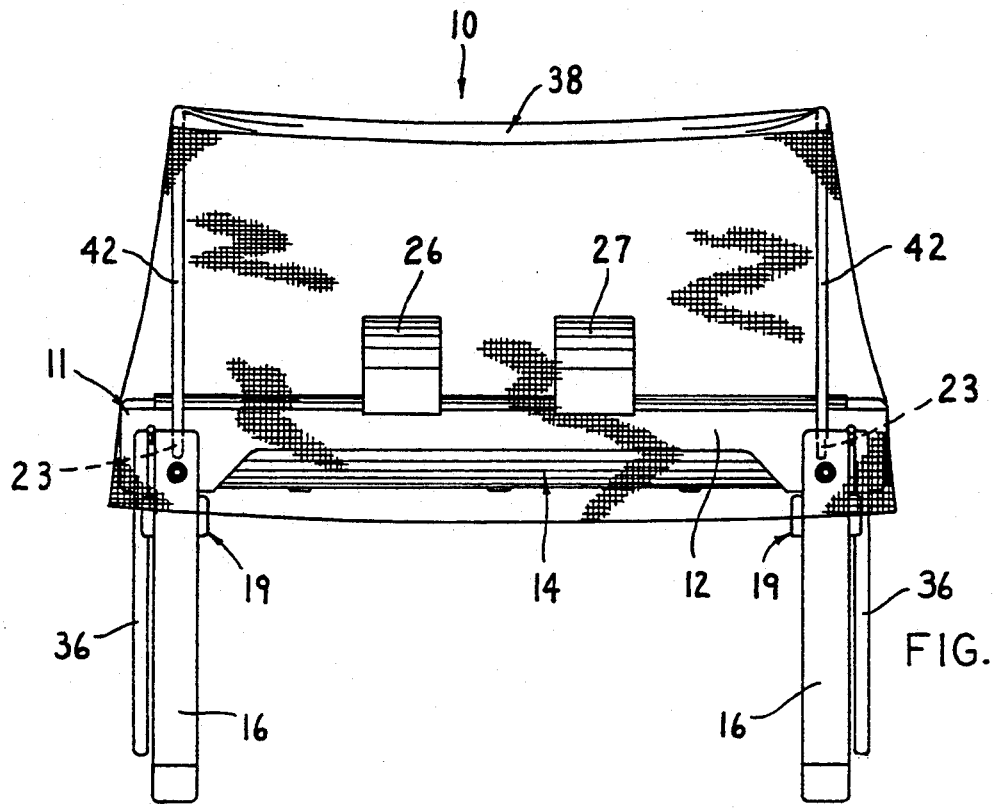
FIG. 6 is a second embodiment of the structure illustrated in FIG. 4.

As illustrated in FIG. 6, a plurality, here four dowels 42 (see also FIG. 8) are provided, the lower ends of which are reduced in diameter to removably but yet snugly fit into the dowel receiving sockets 23 in the upper ends of each of the legs 16. The dowels 42 have a length that corresponds generally to the length of each of the arms 36. The dowels 42 provide an alternate support for the mosquito netting-like material 38.

If desired, grommeted holes 43 can be provided in the support hammock 14. This is particularly advantageous when the support hammock 14 is made of a water-repellant material. Thus, when the infant is placed onto the upwardly facing surface of a water-repellant support hammock 14, the infant may be bathed, water passing through the grommeted holes 43 to facilitate drainage of the water that may collect on the upper surface of the support hammock 14.

Figure 8:
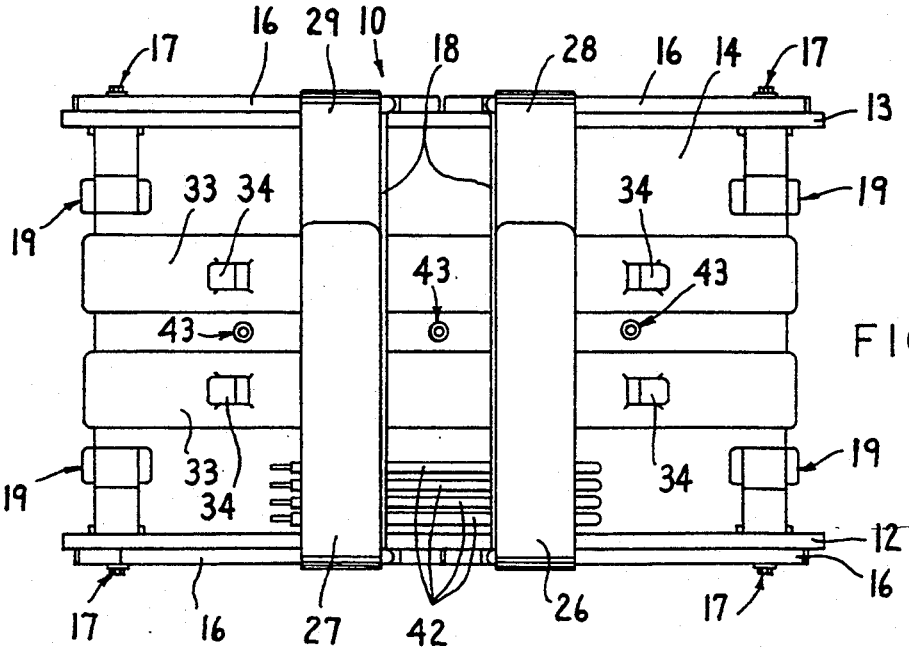
FIG. 8 is a top view of FIG. 7.

As illustrated in FIGS. 7 and 8, the infant support 10 described above can be converted from an upright condition thereof illustrated in FIGS. 1 to 6 to a collapsed position. As stated above, FIG. 7 shows the frame 11 upside down from that illustrated in FIG. 6. The infant holding straps 26 to 29 are now positioned to overlie what was heretofore the bottom surface of the support hammock 14. The infant holding straps now, when fastened by the VELCRO material 31, function to prevent the arms 36 as well as the legs 16 to which they are pivotally secured from pivoting out of the collapsed position. Further, the rocker slats 33 are also positioned underneath the straps as illustrated in FIG. 8 as are the dowels 42. Thus, the entire assembly is confined within somewhat of a rectangular volume capable of being easily packaged into a cardboard box for sale and storage purposes.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An elongated infant support, comprising:

a frame having a pair of elongated and parallel side frame members and a leg member pivotally secured to each longitudinal end of said side frame members for movement between an upright position for supporting said side frame member in spaced relation above a support surface on which a lower end of said leg members rest and a collapsed position generally parallel to said side frame members, said frame further including transverse frame members for establishing a lateral spacing between said side frame members;

a supporting hammock and securement means for securing said supporting hammock to said side frame members, said supporting hammock including an infant holding means secured to said frame and movable between a first position overlaying an upwardly facing surface of said support hammock and a second position lying at a side of said frame as well as a releasable connecting means for facilitating a releasable securement of said infant holding means in said first position, a release of said releasable connecting means facilitating a movement of said infant holding means to said second position, said infant holding strap means including at least a pair of straps, one end of each thereof being secured to opposite side frame members and aligned so that free ends thereof overlap, said straps being also adapted to overlay in a third position a downwardly facing surface of said supporting hammock, said releasable connecting means also facilitating a releasable securement of said straps in said third position overlaying said downwardly facing surface;

a pair of parallel rocker slats extending generally perpendicular to a longitudinal axis of said side frame members; and releasable coupling means for securing each end of a said rocker slat to said lower end of a pair of laterally spaced legs to enable said infant support to be rocked when said rocker slats are connected to said lower ends of a respective pair of transversely spaced said leg, said leg members being pivotal to a position wherein longitudinal axes thereof are parallel to a longitudinal axis of said support hammock, said rocker slats being uncoupled from said legs and oriented so that longitudinal axes thereof are generally parallel to said longitudinal axis of said support hammock, said straps when coupled together in said third position by said releasable connecting means facilitating a binding of said legs and said rocker slats to said side frame members.

2. The elongated infant support according to claim 1, wherein said supporting hammock is made of a water-repellant material.

3. The elongated infant support according to claim 2, wherein at least one grommeted opening is provided through said water-repellant material.

4. The elongated infant support according to claim 4, wherein said releasable connecting means includes a hook-and-loop type material fastener for connecting said free ends to one another.

5. An elongated infant support, comprising:

a frame having a pair of elongated and parallel side frame members and a leg member pivotally secured to each longitudinal end of said side frame members for movement between an upright position for supporting said side frame member in spaced relation above a support surface on which a lower end of said leg members rest and a collapsed position generally parallel to said side frame members, said frame further including transverse frame members for establishing a lateral spacing between said side frame members, an upper end of each leg including a post means positionable so as to extend upwardly from said upper end of said legs when said legs are in said upright position for defining a support for a mosquito netting-like material, upper ends of said post means terminating in a common plane parallel to a plane containing said side frame members;

a mosquito netting-like material for draping over said upper ends of said post means;

a supporting hammock and securement means for securing said supporting hammock to said side frame members;

a pair of parallel rocker slats extending generally perpendicular to a longitudinal axis of said side frame members; and releasable coupling means for securing each end of a said rocker slat to said lower end of a pair of laterally spaced legs to enable said infant support to be rocked when said rocker slats are connected to said lower ends of a respective pair of transversely spaced said leg.

6. The elongated infant support according to claim 5, wherein said post means includes an arm and pivot means for pivotally securing said arm to said upper end of each said leg, each said arm being pivotal between a position coextensive with and parallel to a respective leg and a position constituting an upward extension of said leg.

7. The elongated infant support according to claim 5, wherein said post means includes a dowel and releasable dowel end and socket connecting means for facilitating a releasable connection of said dowel to said upper end of each said leg so as to constitute said upward extension of said leg.

8. The elongated infant support according to claim 5, wherein said supporting hammock includes an infant holding means secured to said frame and movable between a first position overlaying from side-to-side an upwardly facing surface of said support hammock and a second position lying at a side of said frame as well as a releasable connecting means for facilitating a releasable securement of said infant holding means in said first position, a release of said releasable connecting means facilitating a movement of said infant holding means to said second position, wherein said straps are also adapted to overlay a downwardly facing surface of said supporting hammock in a third position thereof, wherein said releasable connecting means also facilitates a releasable securement of said straps in said third position overlaying said downwardly facing surface, and wherein said leg members are pivotal to a position wherein longitudinal axes thereof are parallel to a longitudinal axis of said support hammock, said rocker slats being uncoupled from said legs and oriented so that longitudinal axes thereof are generally parallel to said longitudinal axis of said support hammock, said straps faciling a binding of said legs, said rocker slats and said post means to said frame members.

* * * * *

UNITED STATES PATENT AND TRADEMARK OFFICE

CERTIFICATE OF CORRECTION

PATENT NO. : 5 271 107

DATED : December 21, 1993

INVENTOR(S) : Sonia M. GOF et al

It is certified that error appears in the above-identified patent and that said Letters Patent is hereby corrected as shown below:

Column 5, line 26; change "4" to ---1---.

Signed and Sealed this

Twenty-fourth Day of May, 1994

*Attest:*

Bruce Lehman

BRUCE LEHMAN

*Attesting Officer*

*Commissioner of Patents and Trademarks*